US009132943B2

(12) United States Patent
Jack

(10) Patent No.: US 9,132,943 B2
(45) Date of Patent: Sep. 15, 2015

(54) COVER FOR FOOD CONTAINERS

(71) Applicant: James M. Jack, Deer Park, NY (US)

(72) Inventor: James M. Jack, Deer Park, NY (US)

( * ) Notice: Subject to any disclaimer, the term of this patent is extended or adjusted under 35 U.S.C. 154(b) by 0 days.

(21) Appl. No.: 14/558,158

(22) Filed: Dec. 2, 2014

(65) Prior Publication Data

US 2015/0083741 A1 Mar. 26, 2015

Related U.S. Application Data

(63) Continuation of application No. 13/946,385, filed on Jul. 19, 2013, now Pat. No. 8,925,761.

(60) Provisional application No. 61/673,905, filed on Jul. 20, 2012.

(51) Int. Cl.
*B65D 43/16* (2006.01)
*B65D 43/02* (2006.01)

(52) U.S. Cl.
CPC ..... *B65D 43/161* (2013.01); *B65D 43/0202* (2013.01); *B65D 43/0204* (2013.01); *B65D 43/0212* (2013.01); *B65D 2543/0025* (2013.01); *B65D 2543/00231* (2013.01); *B65D 2543/00296* (2013.01); *B65D 2543/00305* (2013.01); *B65D 2543/00379* (2013.01); *B65D 2543/00537* (2013.01); *B65D 2543/00648* (2013.01); *B65D 2543/00694* (2013.01); *B65D 2543/00759* (2013.01); *B65D 2543/00805* (2013.01); *B65D 2543/00842* (2013.01)

(58) Field of Classification Search
CPC .. B65D 43/0204; B65D 43/161; B65D 43/16; B65D 43/14; B65D 51/242; B65D 41/18; B65D 41/16; B65D 45/18
USPC ..... 220/826, 810, 259.2, 259.1, 256.1, 220/254.6, 254.3, 254.1, 254.2, 662, 602, 220/377, 200
See application file for complete search history.

(56) References Cited

U.S. PATENT DOCUMENTS

| | | | |
|---|---|---|---|
| 1,978,375 | A | 10/1934 | Russakov |
| 7,258,255 | B2 | 8/2007 | Vogel et al. |
| 8,925,761 | B2 | 1/2015 | Jack |
| 2006/0037964 | A1 | 2/2006 | Su |
| 2013/0233874 | A1 | 9/2013 | Sundnes |

*Primary Examiner* — Robert J Hicks
(74) *Attorney, Agent, or Firm* — Amster, Rothstein & Ebenstein, LLP

(57) ABSTRACT

A cover for a food container includes a first cover piece and a second cover piece. The second cover piece is hingably and releasably coupled to the first cover piece so that the first cover piece and the second cover piece are separable from one another. At least one tab extends laterally away from at least one of the first cover piece and the second cover piece, and is engageable by a user to lift an end of the at least one of the first cover piece and the second cover piece.

20 Claims, 9 Drawing Sheets

COVER FOR FOOD CONTAINERS

CROSS REFERENCE TO RELATED APPLICATION

This application is a Continuation of U.S. patent application Ser. No. 13/946,385, filed on Jul. 19, 2013, and claims the benefit of and priority to U.S. Provisional Patent Application No. 61/673,905, filed on Jul. 20, 2012, the entire contents of each of which is incorporated by reference herein.

FIELD

The present invention generally relates to covers for food containers.

SUMMARY

In exemplary embodiments of the present disclosure, a cover for a food container is disclosed, and comprises a first cover piece and a second cover piece. The second cover piece is hingably and releasably coupled to the first cover piece so that the first cover piece and the second cover piece are separable from one another. In embodiments, the first cover piece is at least partially transparent. In embodiments, the second cover piece is at least partially transparent.

In embodiments, at least one of the first cover piece and the second cover piece includes a hook configured to engage a portion of the other of the first cover piece and the second cover piece. In embodiments, one of the first cover piece and the second cover piece includes a slot configured to engage the hook on the other of the first cover piece and the second cover piece. In embodiments, the slot is bounded by a pin that has a cylindrical configuration. In embodiments, one of the first cover piece and the second cover piece includes a body and a rim at least partially surrounding the body. In embodiments, a rib protrudes from an underside of the rim. In embodiments, the rib is configured to engage a portion of a container. In embodiments, the rim includes a downwardly extending flange. In embodiments, a ridge between the rib and the downwardly extending flange is configured to engage a portion of a container such that relative movement between one of the first cover piece and the second cover piece is inhibited.

In embodiments, one of the first cover piece and the second cover piece include a pair of hooks. In embodiments, at least one of the first cover piece and the second cover piece includes an opening for receiving an item therethrough.

In embodiments of the present disclosure, a cover for a food container is disclosed, and comprises a first cover piece and a second cover piece. The first cover piece includes a first body at least partially surrounded by a first rim, at least one hook extending from the first rim, and at least one first flange extending downwardly from the first rim. The second cover piece is hingably and separably coupled with the first cover piece and includes a second body at least partially surrounded by a second rim, at least one slot formed in the second body for receiving the at least one hook, and at least one second flange extending downwardly from the rim.

In embodiments, a sloped wall is defined between at least one of the first rim and the first body and the second rim and the second body. In embodiments, at least one of the first cover piece and the second cover piece includes at least one additional flange extending downwardly therefrom. In embodiments, at least one of the first cover piece and the second cover piece includes at least one tab extending laterally therefrom. In embodiments, at least one of the first cover piece and the second cover piece includes a transparent region.

BRIEF DESCRIPTION OF THE DRAWINGS

The features and advantages of the disclosure will be more fully understood with reference to the accompanying figures, wherein.

DETAILED DESCRIPTION

Figure 1:
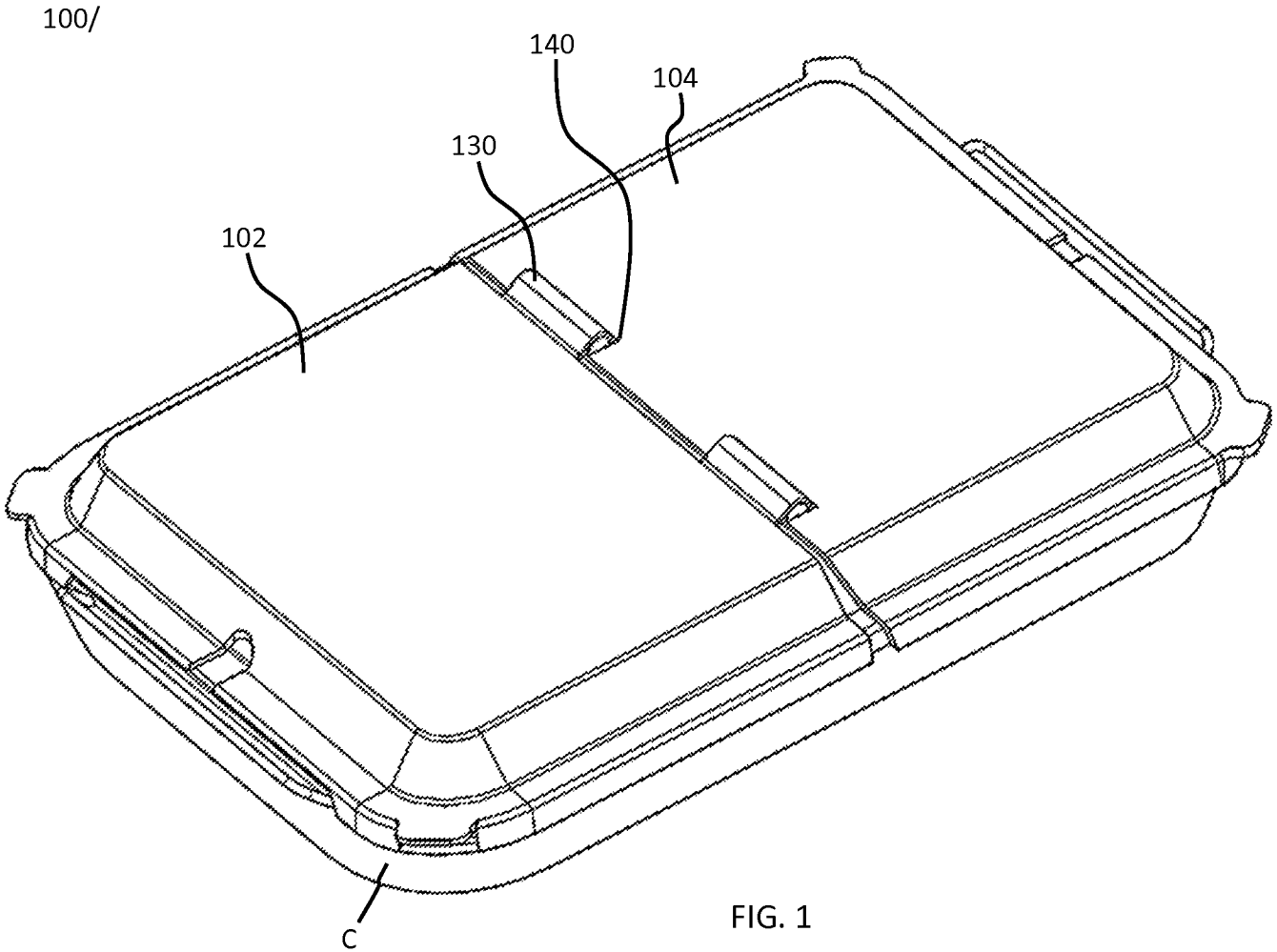
FIG. 1 is a perspective view of a cover atop a container according to an exemplary embodiment of the present disclosure.

The present invention generally relates to transparent food container covers which include separable pieces that may be connected through one or more hinges. The cover or lid may be placed over and cover food containers, e.g., chafing dishes, food pans, serving trays, or storage containers, to name a few. The drawing figures are not necessarily drawn to scale and certain figures may be shown in exaggerated, generalized, or schematic form in the interest of clarity and conciseness.

Referring initially to FIG. 1, a cover according to an exemplary embodiment is disclosed generally as 100. Cover 100 includes a first cover piece 102 that may be separably and/or hingably coupled with a second cover piece 104. First cover piece 102 and second cover piece 104 may be substantially similar but for one or more hooks 130 located on the first cover piece 102 that are insertable into respective slots 140 located in the second cover piece 104, as will be described further below.

Cover 100 may be configured for use with a container C, e.g., a chafing dish, food pan, serving tray, or storage container, to name a few. In embodiments, first cover piece 102 and/or second cover piece 104 may be formed of a transparent material, e.g., a polymeric material such as plastic, a composite or glass, to allow a user to view the contents of the container C without lifting the cover 100. First cover piece 102 and/or second cover piece 104 may have a refractive index, e.g., between and including about 1 and about 2. In embodiments, first cover piece 102 and second cover piece 104 may have other respective refractive indices. In embodiments, first cover piece 102 and/or second cover piece 104 may be wholly transparent or partially transparent, e.g. first cover piece 102 and/or second cover piece 104 may have a transparent region and/or may incorporate a transparent window.

Figure 2:
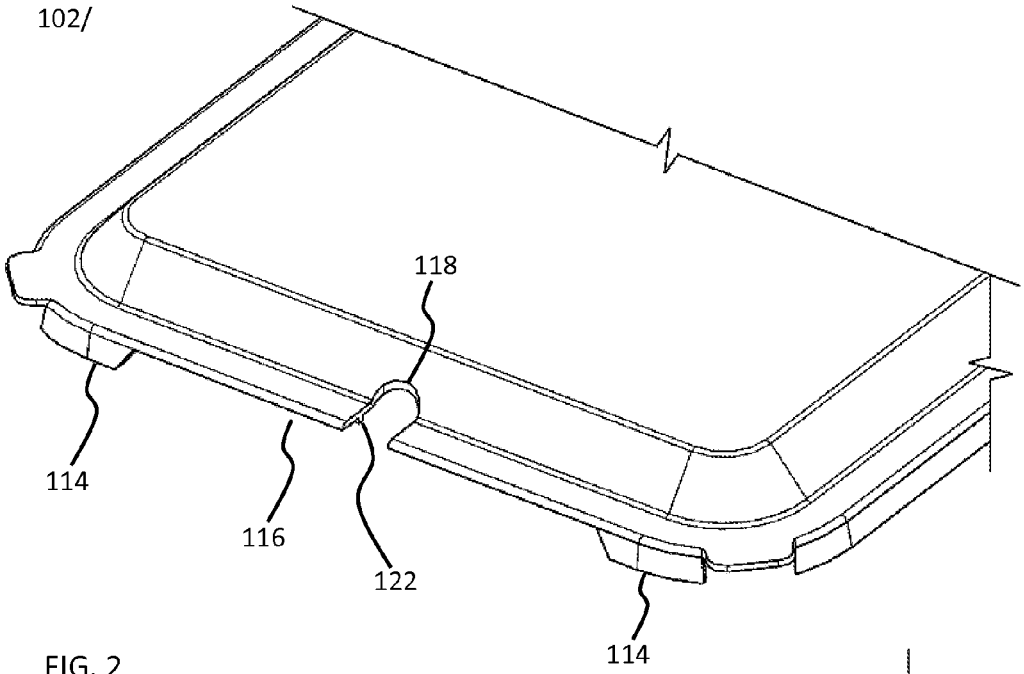
FIG. 2 is a top perspective view of a portion of the cover shown in FIG. 1.
Figure 3:
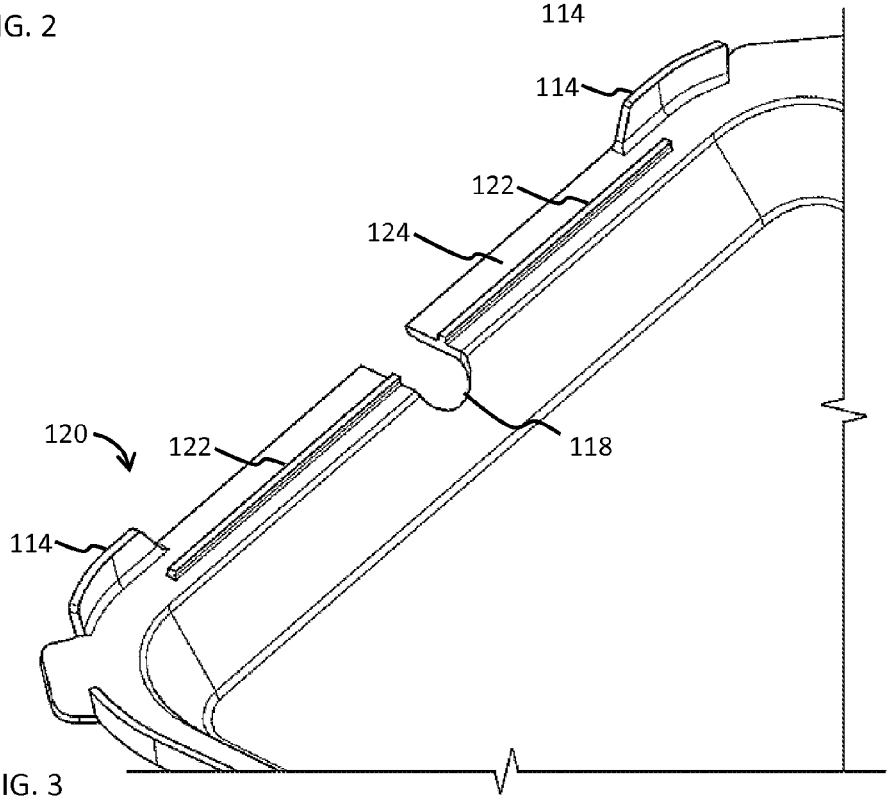
FIG. 3 is a bottom perspective view of a portion of the cover shown in FIG. 2.

Referring to FIGS. 2, and 3, the first cover piece 102 is shown in perspective view. First cover piece 102 may have a substantially rectangular plan profile. In embodiments, first cover piece 102 may have a differently-shaped plan profile, e.g., square, circular, ovoid, elliptical, or triangular to name a few. First cover piece 102 may have a complementary configuration to a container upon which it sits. As shown, first cover piece 102 may have a generally concave cross-sectional profile, e.g., first cover piece 102 has generally downwardly-sloping surfaces extending away from a geometric center of the first cover piece 102. First cover piece 102 may be configured to be placed on or fit over, for example, container C. First cover piece 102 includes a body 106 at least partially surrounded by a rim 108. Body 106 may be configured as a substantially planar section of first cover piece 102. Rim 108 my have a substantially flange configuration that extends away from the body 106. One or more sloped walls 107 may be disposed between the body 106 and the rim 108 such that the body 106 is disposed above the rim 108. When first cover piece 102 is placed atop container C, an interior volume is formed within which substances, such as solid and/or liquid food may be stored.

Cover piece 102 may include one or more tabs 110 extending laterally away from the rim 108. Tabs 110 present a protruding surface for engagement by, e.g., the index finger and thumb of a user to lift an end of cover piece 102. Tabs 110 may be located on respective corners of the rim 108 of cover piece 102 or elsewhere along the periphery of the rim 108. In embodiments, such tabs may be any suitable shape or configuration, e.g., a knob, handle, or ledge, to name a few.

Cover piece 102 may also include one or more flanges 112, 114 extending downwardly from the rim 108. Flanges 112, 114 may define an interior wall configured to engage a portion, e.g., a rim or side, of container C to maintain cover piece 102 in a proper orientation relative to the container C, for example, inhibiting cover piece from failing into the container C. Tabs 110 may be positioned between flanges 112, 114, at respective corners of the cover piece 102, as shown, such that the placement of flanges 112, 114 may not interfere with a user's grasping of tabs 110. In embodiments, tabs 110 may be placed at any desirable location along the first cover piece 102. As shown, flanges 114 may be spaced along an end of the cover piece 102 such that a cutout 116 is presented between the flanges 114 along the end of the cover piece 102. Cutout 116 may have a shape and/or dimension suitable to accommodate a handle H or other protruding structure of the container C such that the cover piece 102 may be placed atop the container C in a flush, e.g., flat, level, and/or non-interfering, manner.

Cover piece 102 may include an opening 118 for holding, e.g., facilitating passage of and/or supporting, items such as serving spoons, serving forks, and other serving utensils, to name a few. One end of such an item may be disposed within cover C, while another the other end, e.g., a handle, of the item may extend out through the opening 118 for grasping and/or manipulation by a user. Opening 118 may have a rounded-rectangular shape, as shown. In embodiments. opening 118 may have other suitable shapes, e.g., rectangular, square, elliptical, ovoid, and/or triangular, to name a few.

Cover piece 102 may include a positioning mechanism 120 inhibiting, e.g., reducing or preventing, cover piece 102 from moving, e.g., slipping and/or sliding, with respect to container C. Positioning mechanism 120 may inhibit cover piece 102 from inadvertently sliding and/or falling away from container C during use. Positioning mechanism 120 may comprise a rib 122 formed along an underside of the rim 108 along an end of the cover piece 102. Rib 122 and flanges 114 may bound a ridge 124 between which an edge, e.g., rim, of container C may be placed (not shown). In this manner, the cover piece 102 may move, e.g., slide and/or shift, with respect to an edge of the container C within ridge 124, but is substantially inhibited from moving beyond the flanges 114 or rib 122. In embodiments, rib 122 and flanges 114 may be configured and/or positioned to accommodate at least a portion, e.g., an edge or rim, of a differently-shaped container C.

As described above, first cover piece 102 and second cover piece 104 may include substantially similar structure but for respective hooks 130 and slots 140, e.g., second cover piece 104 may have a substantially similar body and rim and include tabs 110, flanges 112, 114, cutout 116, and opening 118 and positioning mechanism 120. The particular configurations of the hooks 130 and slots 140 will be discussed further below with respect to operation of the cover 100.

Referring to FIGS. 4, 5, 6, 7, 8, 10, 11, 12, and 13, cover piece 102 and cover piece 104 may be hingably coupled such that the cover piece 102 and cover piece 104 may pivot relative to one another. In the exemplary embodiment shown, first cover piece 102 includes a pair of hooks 130 that are configured for insertion into a respective pair of slots 140 in the second cover piece 104.

Hooks 130 may have a curvate configuration, as shown, and may extend away from the body 106 of first cover piece 102. Hooks 130 may be spaced apart along an edge of the body 106 of first cover piece 102. In embodiments, hooks 130 may have a variety of shapes and configurations, e.g., a serpentine configuration or incorporating angles and/or multiple and/or variable radii of curvature therealong.

Slots 140 are disposed within the body of second cover piece 104 and are positioned such that slots 140 may receive hooks 130 when first cover piece 102 and second cover piece 104 are brought into proximity, e.g., over a container C. In the exemplary embodiment shown, each slot 140 may be a region formed between a portion of the body of second cover piece 104 and a pin 142 disposed along an end of the second cover piece 104. Pin 142 may be a substantially cylindrical member to configured complement a curvature of a respective hook 130 to facilitate pivoting of the first cover piece 102 relative to the second cover piece 104 and vice-versa. In embodiments, each hook 130 may be configured to interengage each pin 142 in a locking relationship, e.g., each hook 130 may exert a compressive force and/or have an interfering geometry with each respective pin 130. Pin 142 may be affixed, e.g., adhered, interference fit, press fit, or ultrasonically welded, to name a few, to the body of second cover piece 104. In embodiments, each pin 142 may be monolithically formed, e.g., injection molded, with the remainder of the body of second cover piece 104. In embodiments, each pin 142 may rotatably coupled along an end of the body of second cover piece 104 such that each pin 142 is configured to rotate along its major axis with respect to the body of second cover piece 104. In embodiments, slots 140 may be formed within portions of the body of second cover piece 104 that are devoid of pins 142. In such embodiments, a hook 130 may directly engage the a slot 140. Alternatively, pin 142 may be formed from material from the second cover piece 104, e.g., a pin 142 may be formed by cutting and deforming, such as bending or curling, a portion of the body of second cover piece 104.

A user may grasp second cover piece 104 and lift second cover piece 104 above container C such that the second cover piece 104 pivots relative to hooks 130 about pins 142. In this manner, a user may access the interior volume of container C. A user may lift first cover piece 102 relative to second cover piece 104 in a substantially similar manner as described above to access an opposite side of container C. In embodiments, both first cover piece 102 and second cover piece 104 may be simultaneously lifted with respect to container C, e.g., to access both sides of container C.

Figure 4:
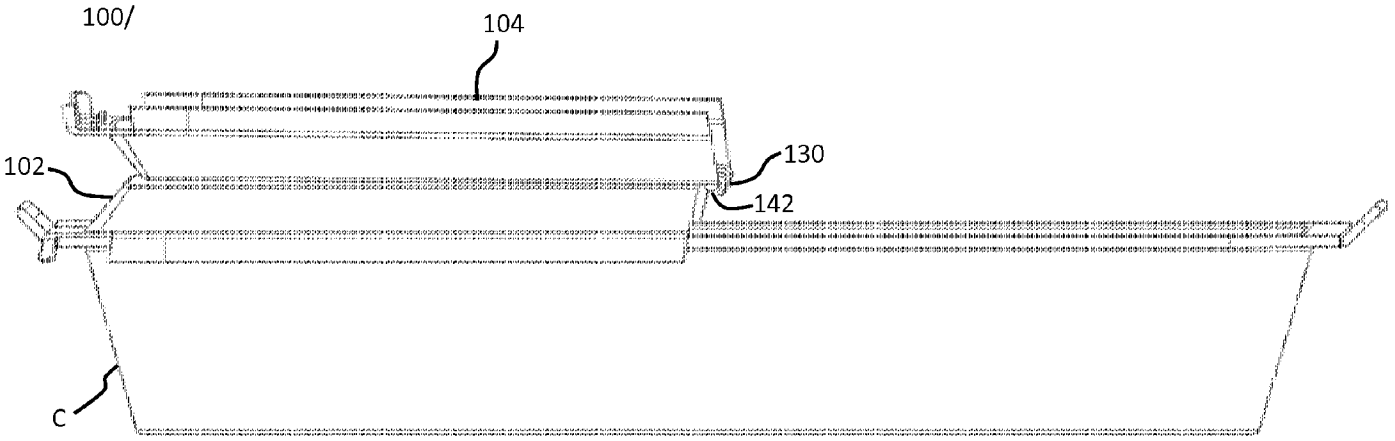
FIG. 4 is a side perspective view of the cover and container shown in FIG. 1, with one cover piece lifted away from the container.
Figure 4A:
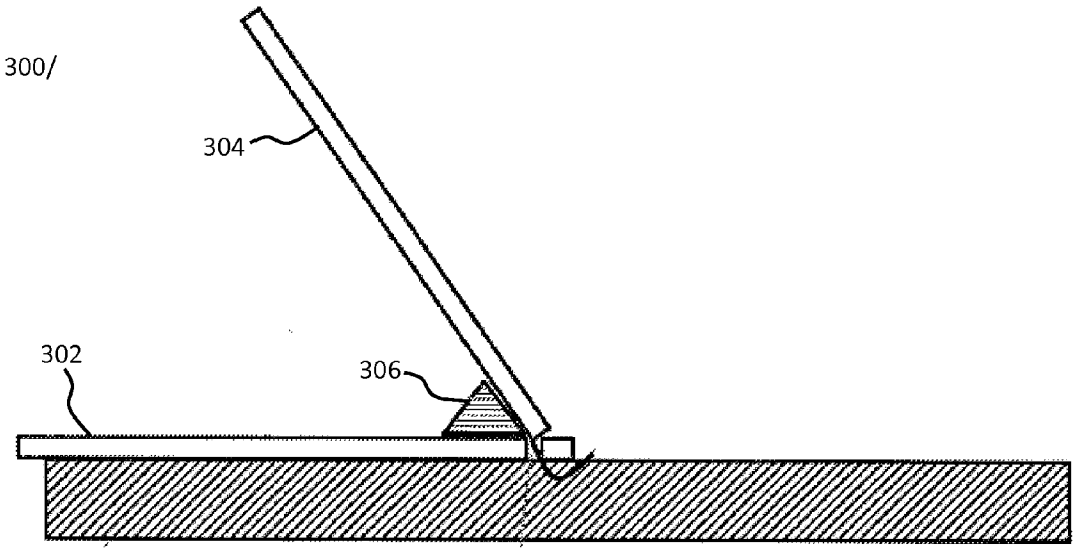
FIG. 4A is a side view of a cover according to an embodiment of the present disclosure.
Figure 5:
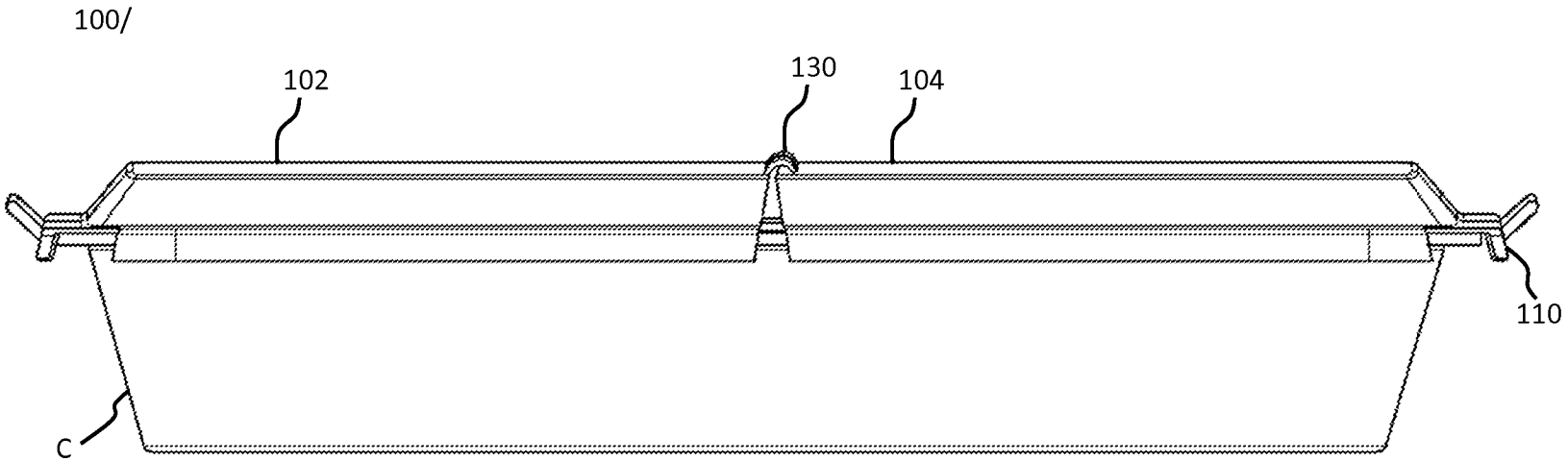
FIG. 5 is a side perspective view of the cover and container shown in FIG. 1.
Figure 6:
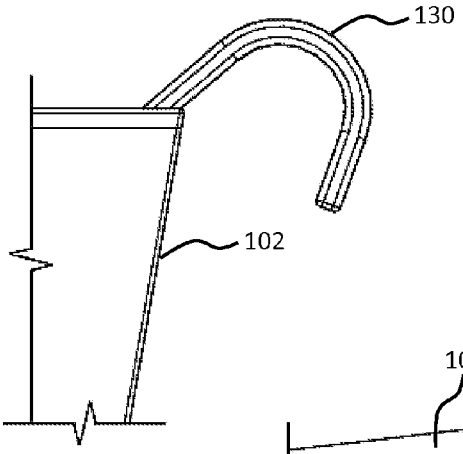
FIG. 6 is a side view of a hook of the cover of FIG. 1.
Figure 7:
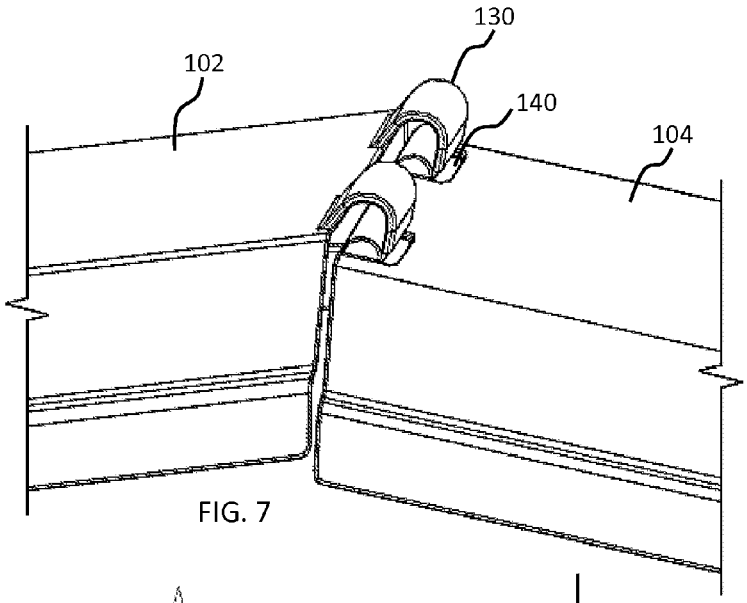
FIG. 7 is a side perspective view of the assembly of the cover of FIG. 1.
Figure 8:
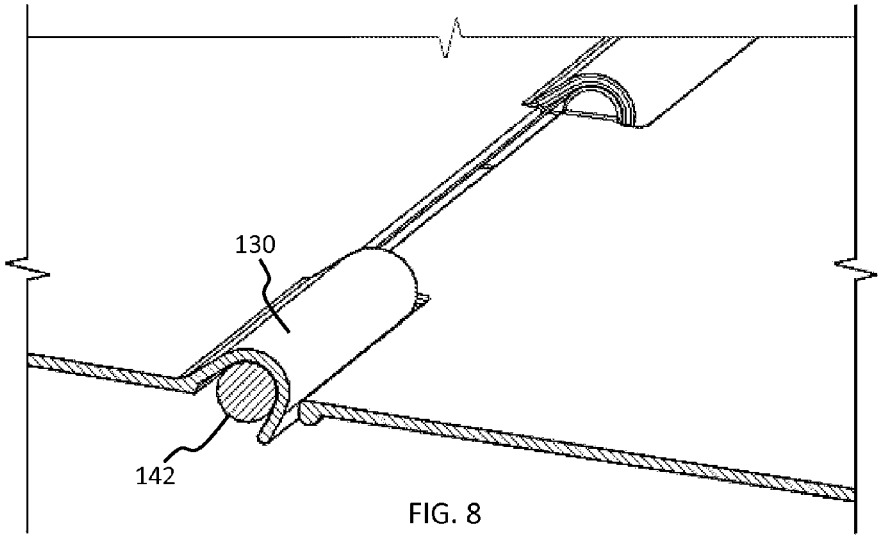
FIG. 8 is a cross-sectional view of the cover of FIG. 1.

Referring to FIG. 4A, a side view of a cover according to an embodiment of the present disclosure is generally designated as 300. Cover 300 may have one or more substantially similar features to cover 100, and will only be discussed with respect to the differences therein. Cover 300 may include a first cover piece 302 and a second cover piece 304. First cover piece 302 and second cover piece 304 may be hingably coupled in a similar manner to first cover piece 102 and second cover piece 104 described above.

Cover 300 may also include one or more stops 306 to inhibit, e.g., reduce, prevent, and/or minimize, one or more of the cover pieces 302, 304 from being rotated and/or pivoted excessively. Stop 306 may be any suitable element that may act as a buffer limiting the rotation and/or pivoting between the cover pieces 302, 304 relative to each other. Stop 306 may be disposed atop cover piece 302 and against cover piece 304. The stop 306 may be affixed through any suitable means to a cover piece 302 and the stop 306 may be any suitable size and length, and may for example, extend the width of the cover piece 302. Stop 306 may have a triangular cross-sectional shape. In embodiments, stop 306 may have a different cross-sectional shape, e.g., circular. The stop 306 may inhibit cover piece 304 from being excessively rotated and/or pivoted and/or from being pressed against cover piece 302. The stop 306 may be comprised of a resilient, soft, or semi-soft material so as to absorb and spread any force applied to the stop 306 when the cover piece 304 is pressed against the stop 306. In embodiments, a stop 306 may be applied and/or connected to cover piece 304. In embodiments, more than one stop 306 may be used with any of the covers described herein. In embodiments, a stop may extend a portion of the length across cover piece 302 and another stop having substantially the same size and shape may extend a portion of the length across second cover piece 304.

Figure 9:
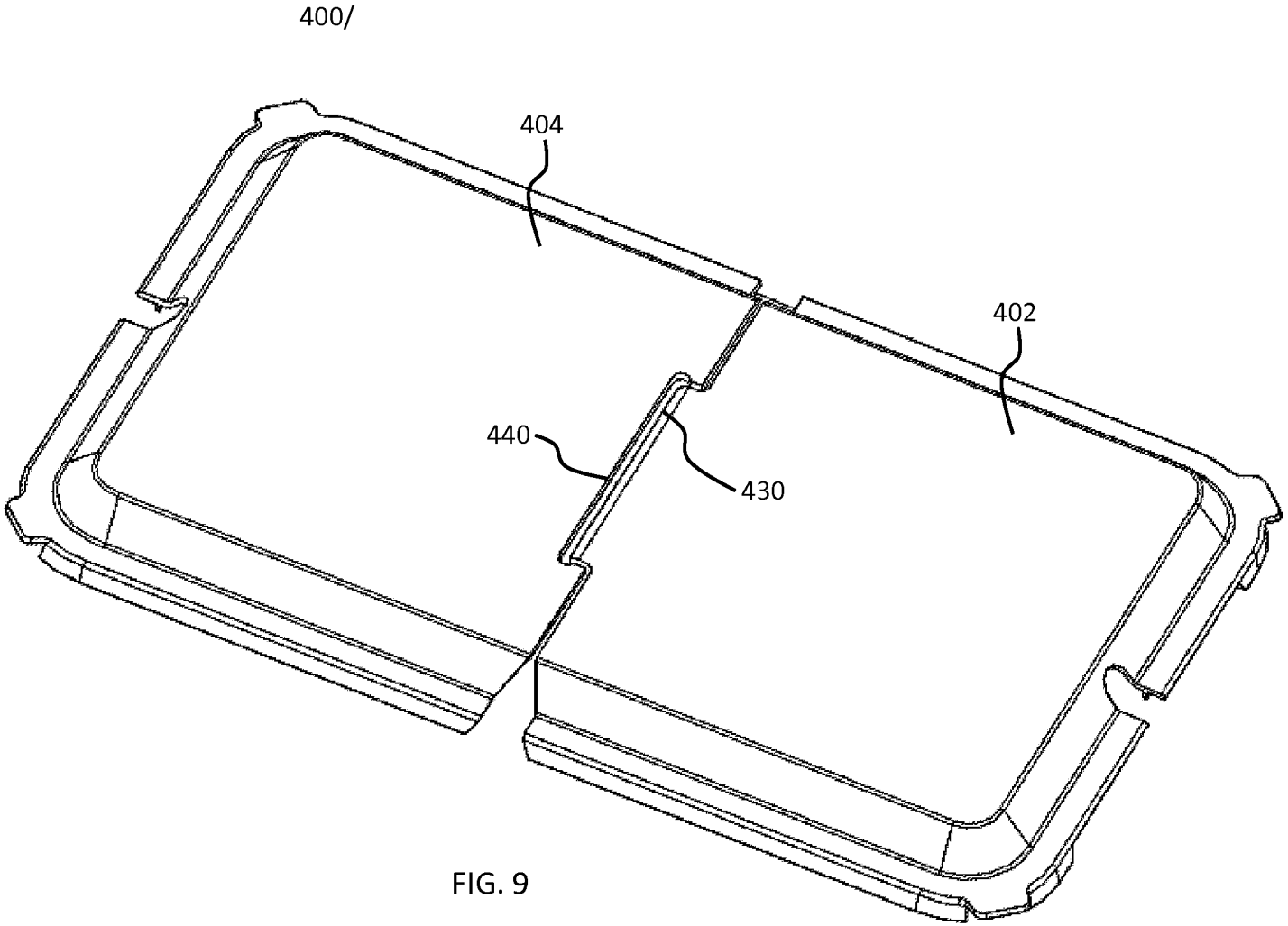
FIG. 9 is a perspective view of a cover according to an embodiment of the present disclosure.
Figure 10:
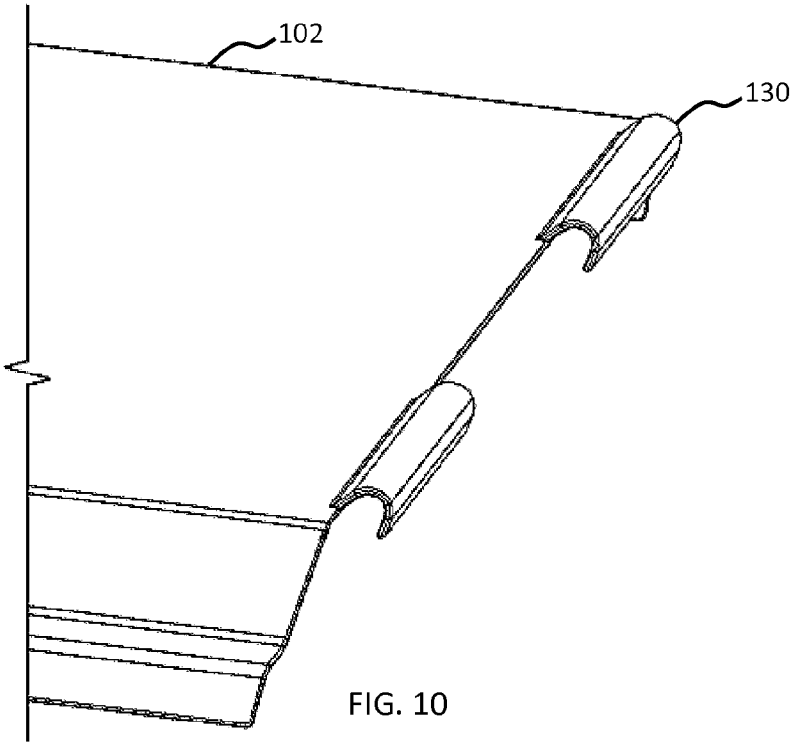
FIG. 10 is a top perspective view of a portion of the cover shown in FIG. 1.
Figure 11:
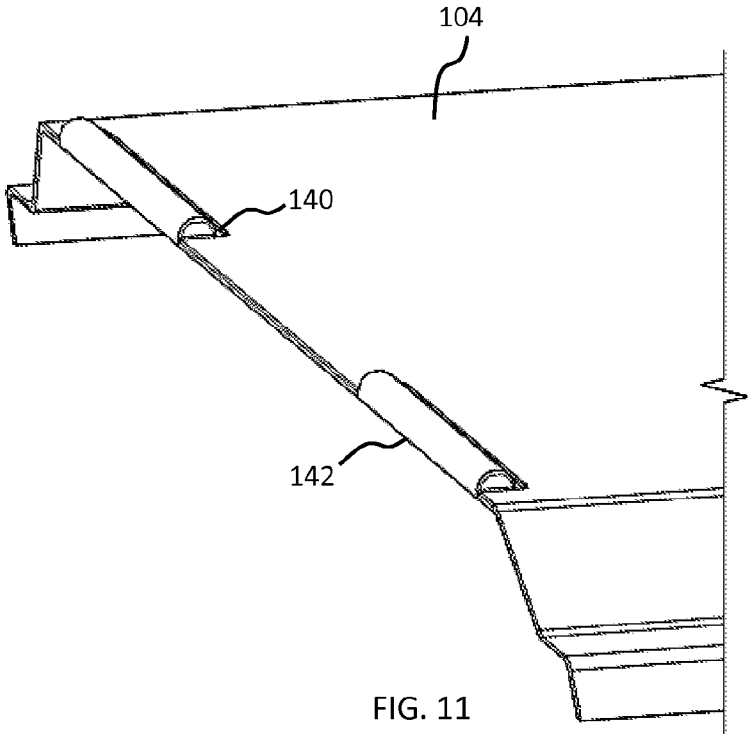
FIG. 11 is a top perspective view of a portion of the cover shown in FIG. 1.
Figure 12:
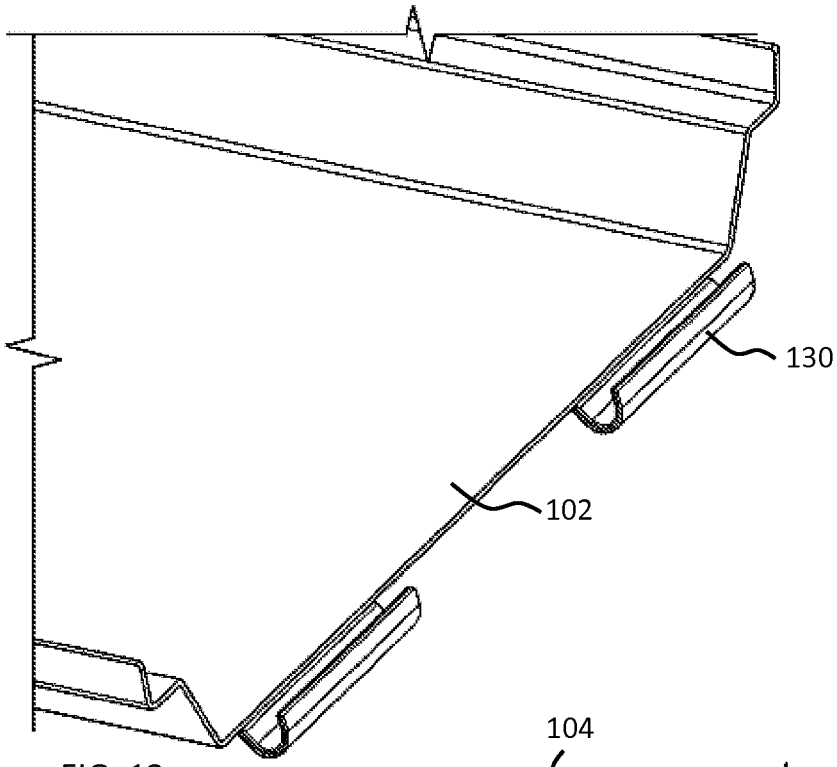
FIG. 12 is a bottom perspective view of the cover piece shown in FIG. 10.
Figure 13:
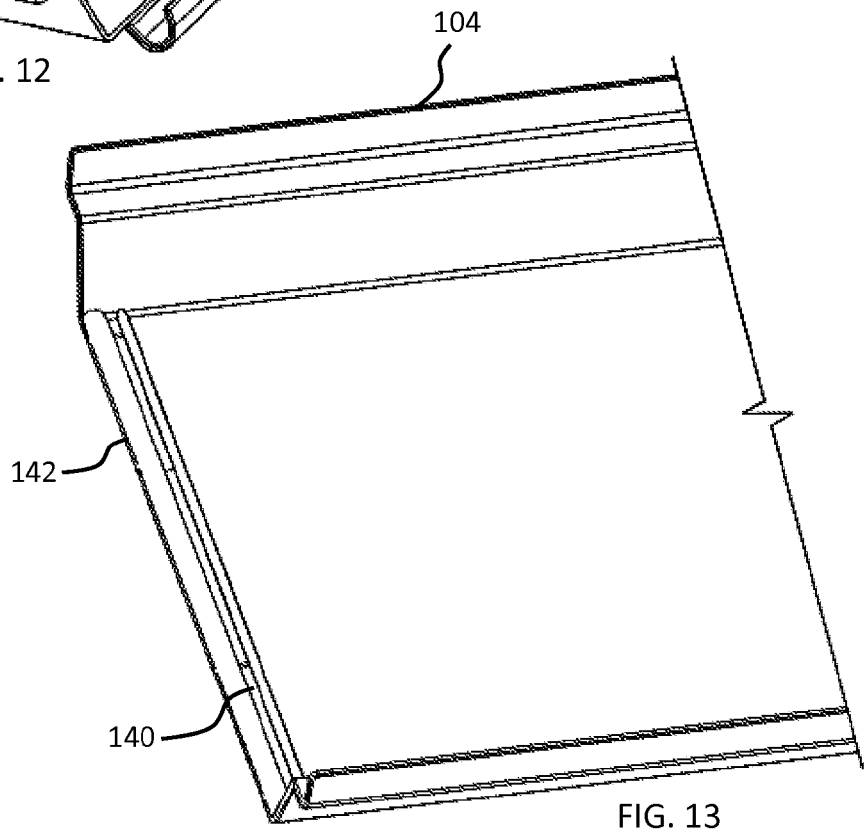
FIG. 13 is a bottom view of the cover piece shown in FIG. 11.

Referring to FIG. 9, an embodiment of a cover according to the present disclosure is generally designated by 400. Cover 400 may include features that are substantially similar to cover 100 described above, and will only be described to discuss the differences therein. Cover 400 may include a single hook 430 on a first cover piece 402 that is configured to engage a slot 440 on a second cover piece 404. Single hook 430 may have a substantially similar configuration to hook 130 described above and may be centrally positioned along an end of first cover piece 402. Single slot 440 may have a substantially similar configuration to slot 140 described above, e.g., may include a pin similar to pin 142 described above (not shown). Cover 400 may operate in a similar manner to cover 100 described above. Referring now to FIGS. 10, 11, 12, and 13, first cover piece 102 and second cover piece 104 of cover 100 are shown separated from one another. First cover piece 102 may be disengaged from second cover piece 104, e.g., by the rotation of hooks 130 away from respective pins 142. A user may, e.g., manually or with a lever or tool, apply a separating force such that the coupling of hooks 130 and pins 142 is overcome. In this manner, first cover piece 102 and second cover piece 104 may be separated such that cover 100 may be broken into smaller sections to facilitate insertion into a cleaning vessel, e.g., a household sink or dishwasher. The separation of first cover piece 102 and second cover piece 104.

Figure 14:
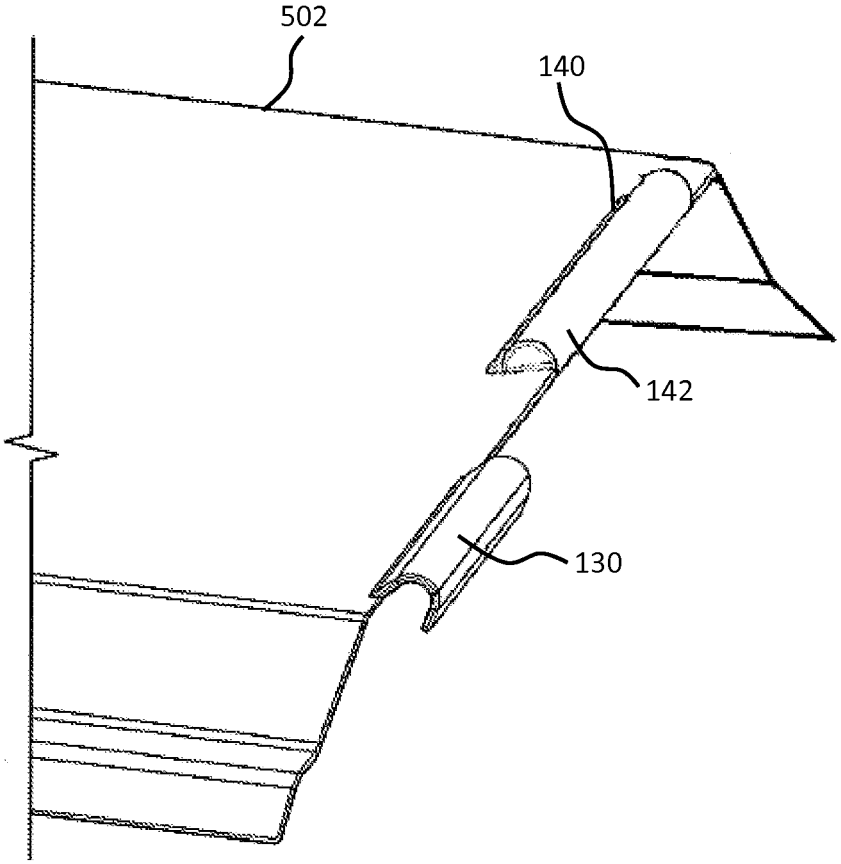
FIG. 14 is a top perspective view of a cover piece according to an embodiment of the present disclosure.

Turning to FIG. 14, in an exemplary embodiment, a cover may include a first cover piece 502 may be constructed with a hook 130 on one side and a slot 140 on the other. A second cover piece (not shown) may similarly have a hook 130 on one side and a slot 140 on the other so that the two cover pieces may be hingably coupled via their respective complementary coupling structures. In such embodiments, first cover piece 502 and the second cover piece may have a substantially similar configuration such that manufacturing costs and logistical concerns, e.g., packaging, shipping, and storage, may be reduced.

In exemplary embodiments, any cover described herein may be manufactured through an injection molding process. For example, with respect to cover 100, first and second cover pieces 102, 104 may each be formed in a mold as one integral piece. In embodiments, aspects of a cover piece formed using an injection molding process with other pre-formed elements that may be attached later. For example, with respect to cover piece 102, tab 110 may be attached through any suitable means, e.g, adhered, press fit, snap fit, or ultrasonically welded, to name a few, after the rest of the cover piece 102 has been formed from an injection molding procedure. In embodiments, elements such as tabs, protrusions, wedges, etc. may be placed into a mold so as to form the cover piece.

In embodiments, the covers described herein may include a recessed area or portion on a top surface thereof. Such a recessed area may be configured to allow an insert or "disc" or insert to be placed or inserted within the recessed area. Such an insert may have an ornamental design, such as a trademark or other suitable designation thereon, so as display or indicate an affiliation with an entity, person, corporation, etc. In exemplary embodiments, one or more different inserted may be removably placed within such recessed portions.

In exemplary embodiments, any one of the cover pieces described herein may be made out of any suitable material, such as, for example, plastic, glass, metal, polypropylene, and combinations thereof In exemplary embodiments, any one of the cover pieces may be dishwasher safe. In exemplary embodiments, any one of the cover pieces may be heat resistant. For example, the cover pieces described herein be subjected directly or indirectly to heat from typically cooking heat sources, without melting. In exemplary embodiments, the cover pieces described herein may be made from any suitable materials that would not leach any chemicals into food. In some exemplary embodiments, any of the covers described herein may be made at least in part with materials that are recyclable.

Now that exemplary embodiments of the present invention have been shown and described in detail, various modifications and improvements thereon will become readily apparent to those skilled in the art.

The invention claimed is:

1. A cover for a food container, comprising:

a first cover piece; and a second cover piece configured for releasable coupling with the first cover;

at least one handle extending laterally away from at least one of the first cover piece and the second cover piece and configured for engagement by a user to lift the at least one of the first cover piece and the second cover piece.

2. The cover of claim 1, wherein at least one of the first cover piece and the second cover piece is at least partially transparent.

3. The cover of claim 1, wherein one of the first cover piece and the second cover piece includes a hook configured to engage a portion of the other of the first cover piece and the second cover piece.

4. The cover of claim 3, wherein one of the first cover piece and the second cover piece includes a slot configured to engage the hook on the other of the first cover piece and the second cover piece.

5. The cover of claim 4, wherein the slot is formed adjacent a cylindrical pin.

6. The cover of claim 1, wherein each of the first cover piece and the second cover piece comprises a body that is at least partially surrounded by a rim.

7. The cover of claim 6, wherein a rib protrudes from an underside of the rim of at least one of the first cover piece and the second cover piece and is configured to engage a portion of a container.

8. The cover of claim 6, wherein a flange extends downwardly from the rim of the at least one of the first cover piece and the second cover piece.

9. The cover of claim 6, wherein a flange and a rib extend downwardly from the rim of at least one of the first cover piece and the second cover piece such that a ridge is formed and is configured to engage a portion of a container.

10. The cover of claim 6, wherein the rim of each of the first cover piece and the second cover piece is disposed adjacent a sloped portion of the respective body.

11. The cover of claim 1, wherein at least one of the first cover piece and the second cover piece includes a cutout dimensioned for receiving an item therethrough.

12. The cover of claim 11, wherein the opening is formed along an outer rim of the at least one of the first cover piece and the second cover piece.

13. A cover for a food container, comprising:

a first cover piece having a slot;

a second cover piece having a hook to engage the first cover piece through the slot of the first cover piece;

a cutout formed along a respective outer rim of at least one of the first cover piece and the second cover piece; and a handle extending from the respective outer rim of at least one of the first cover piece and the second cover piece.

14. The cover of claim 13, wherein the first cover piece and the second cover piece each have a concave configuration.

15. The cover of claim 13, wherein the slot of the first cover piece is formed adjacent a cylindrical pin.

16. The cover of claim 13, wherein a downwardly extending flange extends downwardly from the respective outer rim of at least one of the first cover piece and the second cover piece.

17. The cover of claim 13, wherein a transparent region is disposed along at least one of the first cover piece and the second cover piece.

18. The cover of claim 13, wherein the first cover piece further comprises another slot.

19. The cover of claim 18, wherein the second cover piece further comprises another hook configured to engage the first cover piece through the another slot.

20. The cover of claim 13, wherein the second cover piece further comprises a slot and the first cover piece further comprises a hook configured to engage the second cover piece through the slot of the first cover piece.

* * * * *